US006373185B1

(12) United States Patent
Tyler

(10) Patent No.: US 6,373,185 B1
(45) Date of Patent: Apr. 16, 2002

(54) GAS DISCHARGE LAMPS WITH GLOW MODE ELECTRODES

(75) Inventor: Peter Michael Tyler, Cheltenham (GB)

(73) Assignee: Smiths Industries Public Limited Company, London (GB)

( * ) Notice: Subject to any disclaimer, the term of this patent is extended or adjusted under 35 U.S.C. 154(b) by 0 days.

(21) Appl. No.: 09/235,289

(22) Filed: Jan. 22, 1999

(30) Foreign Application Priority Data

Feb. 23, 1998 (GB) ..... 9803587

(51) Int. Cl.[7] ..... H01J 1/62
(52) U.S. Cl. ..... 313/491; 313/494; 313/567
(58) Field of Search ..... 313/491, 493, 313/634, 494, 609, 600, 631, 492, 317, 567, 238, 326, 601; 206/0.6; 220/2.1

(56) References Cited

U.S. PATENT DOCUMENTS 5,420,481 A 5/1995 McCanney
5,463,274 A 10/1995 Winsor
5,466,990 A 11/1995 Winsor
6,114,809 A * 9/2000 Winsor ..... 313/496

FOREIGN PATENT DOCUMENTS

| | | |
|---|---|---|
| EP | 0 550 047 | 7/1993 |
| EP | 0 653 903 | 5/1995 |
| GB | 2217515 | 10/1989 |
| GB | 2305540 | 4/1997 |
| WO | WO 96/17375 | 6/1996 |

* cited by examiner

*Primary Examiner*—Michael H. Day
*Assistant Examiner*—Joseph Williams

(57) ABSTRACT

A flat panel lamp has internal walls forming a serpentine discharge path between two internal electrodes. Two glow mode electrodes in the form of interdigitated combs are laid on the outside of the front panel of the lamp, on top of the walls. The internal electrodes are connected to a first drive circuit; the glow mode electrodes are connected to a second drive circuit, which drives them at a frequency of about 10 MHz. At high brightness, only the internal electrodes are operative; at low brightness, only the glow mode electrodes are operative; and at intermediate brightness the two sets of electrodes are alternately energized.

7 Claims, 2 Drawing Sheets

GAS DISCHARGE LAMPS WITH GLOW MODE ELECTRODES

BACKGROUND OF THE INVENTION

This invention relates to gas discharge lamps and systems.

The invention is more particularly concerned with gas discharge lamps and systems including control circuits for such lamps that enable them to be dimmed.

Gas discharge lamps, such as fluorescent lamps, have advantages of being able to produce high intensity light with a low power dissipation, they also have a relatively long life and are relatively robust. One disadvantage, however, with these lamps is that their brightness cannot be well controlled over a wide range. Most commercially-available fluorescent lamp dimmers operate by varying the mark-to-space ratio of the drive signal applied to the lamp and can only control brightness over a range of about 150:1, although some dimmers for aerospace applications are capable of controlling light output in the range 2000:1. In U.S. Pat. No. 5420481 there is described a fluorescent lamp system having glow mode electrodes in addition to the two normal electrodes at opposite ends of the lamp. These electrodes extend externally along the length of the lamp and are used to produce low level light output, which enables the output range to be considerably increased. One problem, however, with these glow mode electrodes is that any irregularity or misalignment in the walls of the lamp can lead to a non-uniform field from the glow electrodes and, hence, to a non-uniform light output. Some fluorescent lamps used to backlight displays are bent into a serpentine shape, so as to give a more even illumination over the surface of the display. This form of lamp presents substantial problems in achieving an even illumination using the previous form of glow mode electrodes.

EP-A-653903 describes a fluorescent tube in which one of the discharge electrodes is connected to the end of a single helical wire extending about the tube. As voltage is increased, the discharge moves gradually along the length of the tube. GB 2305540 describes a system for dimming fluorescent tubes by applying a voltage between two parallel helical wires, so that the voltage is applied across the diameter of the tube. This latter arrangement can enable a very good control of dimming at low intensities.

Where displays or the like are backlit, it is necessary to produce even illumination across the display. To produce even illumination efficiently using tubular lamps requires complex and expensive diffuser optics. It is also expensive to bend the tubular lamps by hand into a serpentine shape. Because of this, there has been a move towards using flat panel, planar, fluorescent lamps. Such lamps comprise a box-like structure with parallel internal walls defining a serpentine, or similar path between the two cathodes. These planar lamps can produce an even illumination across their surface at relatively high levels of illumination but the illumination becomes more uneven at low levels. It has been found that, at low levels, there is a tendency for the discharge plasma to adhere to the dividing walls within the lamp. In aircraft applications, it is particularly important, for night-time viewing that there is an even illumination across the display at low brightness levels.

BRIEF SUMMARY OF THE INVENTION

It is an object of the present invention to provide an improved planar gas discharge lamp and system.

According to one aspect of the present invention there is provided a gas discharge lamp including a planar envelope filled with a discharge gas, means defining an elongate discharge path within the envelope, and a first pair of electrodes located at opposite ends of the discharge path for causing discharge within the envelope, the lamp including two glow mode electrodes spaced from one another across the discharge path so that a voltage can be applied between the glow mode electrodes across regions of the discharge path.

The discharge path is preferably a serpentine path defined by a plurality of parallel walls extending part way across the width of the envelope. The glow mode electrodes preferably extend in alignment with the walls and along the same surface of the envelope. The glow mode electrodes are preferably on a front side of the envelope through which light is transmitted. The glow mode electrodes may take the form of two interdigitated combs. Alternatively, the glow mode electrodes may extend along opposite surfaces of the envelope. The glow mode electrodes preferably extend on an external surface of the envelope and may be of a transparent material.

According to another aspect of the present invention there is provided a gas discharge lamp system including a lamp according to the above one aspect of the invention, a first circuit for driving the first pair of electrodes and a second circuit for driving the glow mode electrodes.

The system is preferably arranged such that at high brightness only the first circuit drives the lamp, at low brightness only the second circuit drives the lamp, and at intermediate brightness the first circuit drives the first pair of electrodes for successive periods separated by spaces and the second circuit drives the glow mode electrodes only during the spaces between the periods when the first pair of electrodes are being driven. The first circuit is preferably arranged to reduce the space between the periods of its output, the second circuit being arranged to increase the space between the periods of its output when an intermediate brightness of the lamp is to be increased. The second circuit is preferably arranged to drive the glow mode electrodes at a frequency of the order of at least 5 MHz, which may be of the order of 10 MHz.

According to a further aspect of the present invention there is provided a method of driving a gas discharge lamp of the kind having a planar envelope filled with a discharge gas, means defining an elongate discharge path within the envelope, a first pair of electrodes located at opposite ends of the discharge path for causing discharge within the envelope and two glow mode electrodes spaced from one another across the discharge path so that a voltage can be applied between the glow mode electrodes across regions of the discharge path, the lamp being driven by energizing only the first pair of electrodes at high brightness levels, energizing only the glow mode electrodes at low brightness levels, and at intermediate brightness levels energizing the first pair of electrodes for successive periods separated by spaces, and energizing the glow mode electrodes only during the spaces between the periods when the first pair of electrodes are driven.

The method may include driving the glow mode electrodes at a frequency of the order of at least 5 MHz. The method may include the steps of reducing the space between periods of signals supplied to the first pair of electrodes and increasing the space between periods of signals supplied to the glow mode electrodes when an intermediate brightness of the lamp is to be increased.

A fluorescent lamp system for backlighting a display, in accordance with the present invention, will now be described, by way of example, with reference to the accompanying drawings.

DETAILED DESCRIPTION OF THE PREFERRED EMBODIMENT

Figure 1:
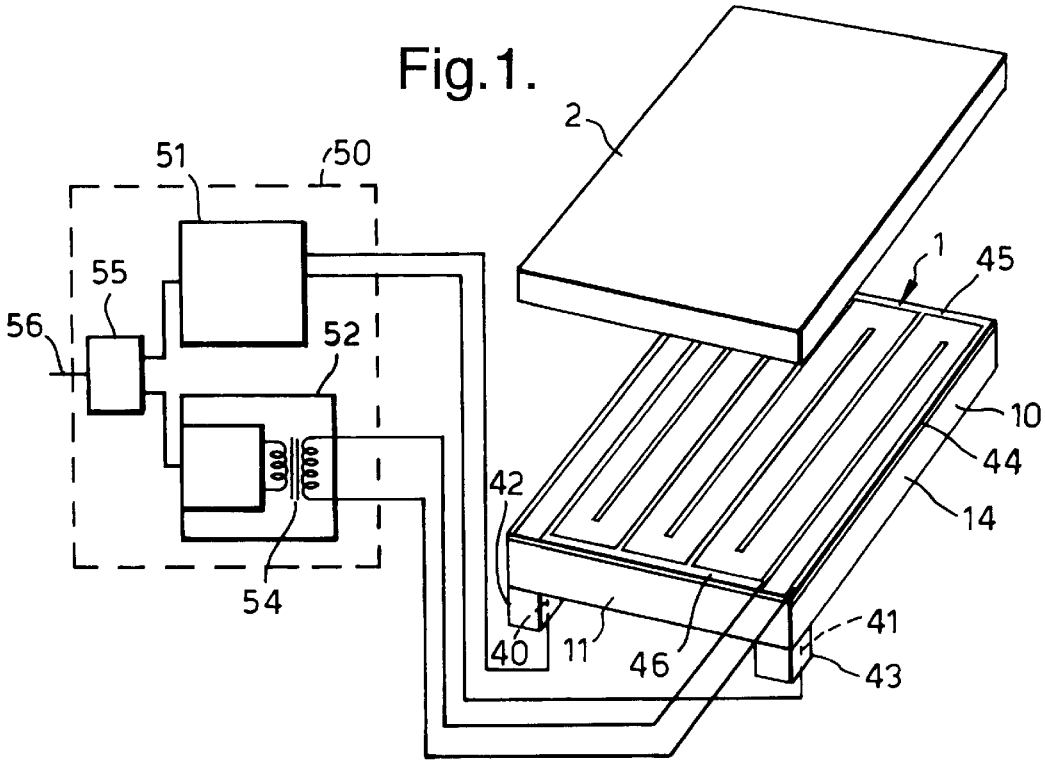
FIG. 1 is a schematic view of the lamp system.
Figure 3:
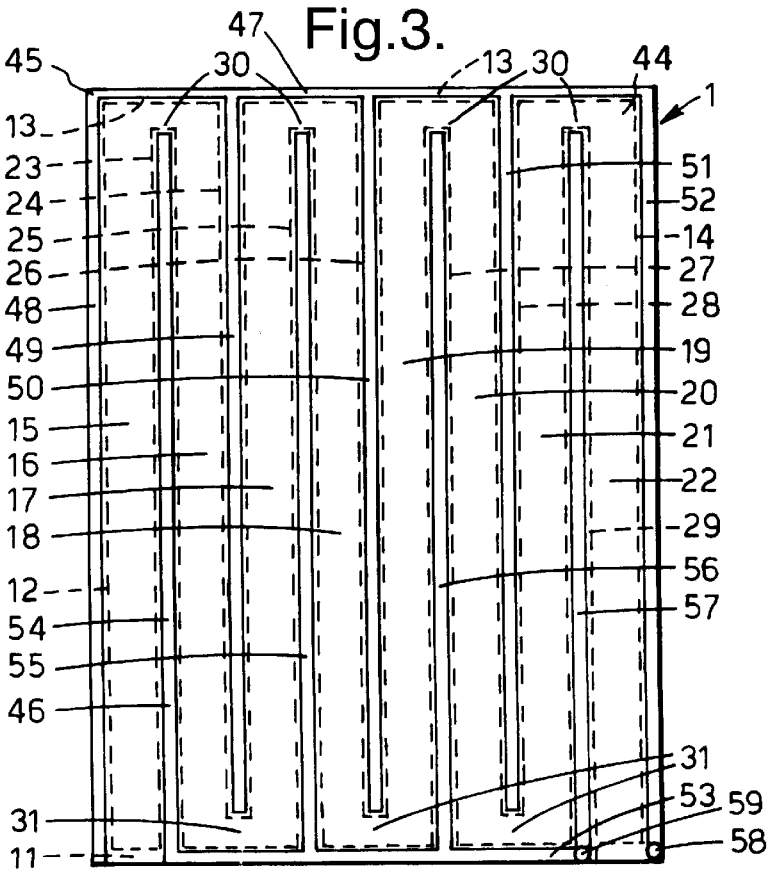
FIG. 3 is a plan view of a part of the lamp in greater detail.

The lamp 1 is shown, for simplicity as being rectangular although it could be formed into other planar shapes, such as square, or circular, to suit its particular application. The envelope of the lamp 1 is provided by a solid rectangular block 10 of ceramic, glass or the like, which is milled or otherwise machined on its upper surface to form four outer walls 11 to 14, and eight, straight, parallel channels 15 to 22 separated from one another by internal dividing walls 23 to 29. The walls 23, 25, 27 and 29 extend from the lower wall 11 (as viewed in FIG. 3) of the block 10 but terminate a short distance before the opposite, upper wall 13, leaving a gap 30 between the end of each dividing wall and the opposite side wall. Similarly, the other walls 24, 26 and 28 extend from the upper wall 13 and terminate a short distance before the lower wall 11, leaving a gap 31 between the end of each dividing wall and the side wall 11. The dividing walls 23 to 29, therefore, define a serpentine path between the walls extending from side to side of the block 10.

The lamp 1 has two internal electrodes 40 and 41 located at opposite ends of the serpentine path. The electrodes 40 and 41, which may be hot or cold cathodes are located in pods 42 and 43 beneath the block 10, which communicate with the interior of the block towards opposite ends of the lower wall 11. The lamp 1 also has a transparent glass plate 44 sealed to the top of the block 10, along the top surfaces of the side walls 11 to 14 and the dividing walls 23 to 29, such as by means of a glass frit, so as to form an enclosed envelope. The envelope formed by the block 10, the electrode tubes 42 and 43 and the glass plate 44 contains a conventional gas discharge mixture and is coated on its inner surfaces with a conventional phosphor material. As so far described, the lamp is conventional.

Figure 2A:
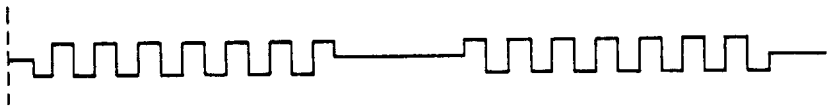
FIGS. 2A to 2F illustrate the outputs from the driving circuit of the system at different brightness.

The lamp 1 also has two glow mode electrodes 45 and 46 arranged in a manner that will be described more fully later. The lamp 1 is located behind a liquid crystal display 2 or some other similar transparent display The system includes a lamp driver unit 50 of the kind described in GB 2305540. The unit 50 has two separate driver circuits 51 and 52 connected respectively to the internal electrodes 40 and 41, and to the glow mode electrodes 45 and 46. The first drive circuit 51 is an a.c. current source similar to those used in conventional fluorescent lamp drive circuits. The circuit 51 supplies a fixed frequency, square wave or sine wave output in the range 20–100 kHz. The output of the drive circuit 51 comprises bursts of pulses separated by spaces without pulses, as shown in FIG. 2A. The repetition rate of the bursts and spaces is chosen to be the lowest at which the eye will not perceive a flicker.

The second, glow mode electrode drive circuit 52 is a sine wave voltage source, which produces a much higher frequency than that of the first drive circuit 51, of around 10 MHz with a voltage of 200–300V rms. The drive circuit 52 has an output transformer 54 with its secondary winding connected at opposite ends to the glow mode electrodes 45 and 46.

Both the first and second drive circuits 51 and 52 are connected to a brightness control unit 55, which receives an input on line 56 indicative of the desired brightness of the lamp. The control unit 51 appropriately controls the first and second drive circuits 51 and 52 to produce the desired level of brightness.

Figure 2B:
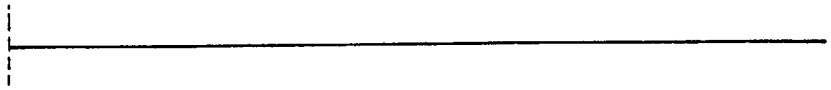

For high levels of brightness of the display, such as around 200 FtL, only the internal electrodes 40 and 41 of the lamp 1 are energized, the control unit 55 holding the second drive circuit 52 off. The control unit 55 controls the magnitude of light output from the lamp 1, in the higher range of illumination, solely by changing the way in which the internal electrodes 40 and 41 are energized. More particularly, the ratio of the length of the bursts of pulses supplied by the first drive circuit 51 to the length of the spaces between the bursts is varied. For maximum illumination, the length of the bursts of pulses is long and there is only a very short space between the pulses. For reduced illumination, the space between the bursts of pulses is increased. FIG. 2B shows that there is no output from the glow mode electrode drive circuit 52 when a high level of brightness is needed.

Figure 2C:
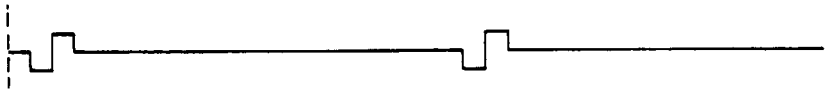
Figure 2D:
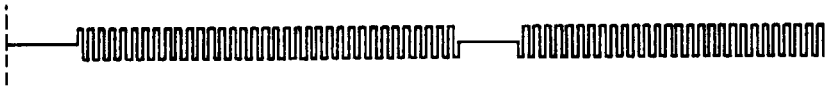
Figure 2E:
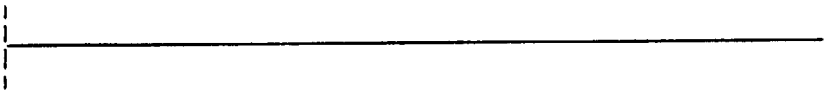
Figure 2F:
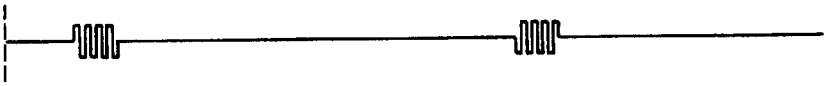

When only a low level of brightness is needed, such as around 0.01 FtL, the control unit 55 holds off the first drive circuit 51, as shown in FIG. 2E. For these low levels of brightness, only the second drive circuit 52 is operative, as shown in FIG. 2F. This circuit 52 supplies bursts of the high frequency sine wave signal to the glow mode electrodes 45 and 46 separated by spaces. Again, the level of brightness at these low levels is varied by altering the ratio between the length of the bursts of high frequency signal and the length of the spaces between them.

For medium levels of brightness, around 1 FtL, the control unit 55 enables both the drive circuits 51 and 52, and more particularly, the control unit is arranged to ensure that only one or other of these circuits is on at any one time, and that they are not both on together, as shown in FIGS. 2C and 2D. To increase brightness within this range of medium brightness, the length of the bursts of pulses from the first drive circuit 51 is increased and the length of time for which the high frequency signals are supplied to the glow mode electrodes 45 and 46 is correspondingly reduced. To reduce brightness, the length of the bursts of pulses from the first drive circuit 51 is reduced and the length of the bursts of high frequency signals supplied to the glow mode electrodes 45 and 46 is correspondingly increased.

It can be seen, therefore, that as brightness is increased from a minimum, the glow mode will gradually increase until the normal mode comes into operation, following which the glow mode will decrease as the normal mode increases. There may be a jump in brightness when the normal mode first comes into operation but, by making the glow mode peak drive level about ten times the minimum normal mode drive level, it ensures that the jump in brightness is only about 10%, which is barely noticeable to the user. Alternatively, the brightness of the lamp could be actively monitored in the different modes and the relative width of the pulse bursts in the different modes altered to reduce the change in brightness at the transition.

In the arrangement described above, the normal mode and glow mode drive signals are never on at the same time. This is because it has been found that the lamp can flicker when both drive signals are on. However, it is possible to reduce flicker when both signals are on if the high frequency signal applied to the glow mode electrodes 45 and 46 is synchronized to the lower frequency supplied to the internal electrodes 40 and 41.

The glow mode operation gives a dimming range of about 150:1, whereas the normal mode operation gives a dimming range of about 2000:1. Because of the overlap between the two modes, which is about 10:1, this gives a total dimming range of about 30000:1.

The relatively high frequency drive signal supplied to the glow mode electrodes 45 and 46 of 10 MHz prevents the spectrum of the lamp being shifted towards the near infra-red end of the spectrum compared with the normal mode. At lower frequencies, of 100's kHz, the glow mode spectrum contains high levels of near infra-red radiation, making a display illuminated with such a lamp difficult to use with night vision aids, which amplify radiation in this range. Also lamps with a lower frequency glow mode would tend to look much pinker at low brightness compared with the normal mode operation at higher brightness. It has been found that, providing the glow mode drive signal is 5 MHz or greater, there is no noticeable change in colour as the lamp is dimmed.

The glow mode electrodes 45 and 46 are formed by two metal tracks on the upper surface of the glass plate 44, which are uninsulated so that there is a maximum efficiency in the glow mode.

One electrode 45 comprises a base 47 extending alongside the edge of the envelope in alignment with the top of the outer wall 13. The electrode 45 also has five parallel arms 48 to 52 extending at right angles to the base 47, the outer arms 48 and 52 extending along opposite sides of the block 10, along its entire length, and aligned above the outer walls 12 and 14. The other three arms 49 to 51 are equally spaced between the outer arms 48 and 52 and are aligned directly above the walls 24, 26 and 28. These arms 49 to 51 terminate at the ends of the walls 24, 26 and 28, so they do not extend along the entire length of the block.

The second glow mode electrode 46 comprises a base 53 aligned with the top of the wall 11 and extending parallel to the base 47 of the first electrode 45. The base 53 does not extend along the entire width of the block 10 but terminates level with the outer ones of the internal dividing walls 23 and 29. The second electrode 46 has four parallel arms 54 to 57 extending at right angles to the base 53 and parallel to the arms of the first electrode 45. The arms 54 to 57 extend from the base and are aligned along the top of the dividing walls 23, 25, 27 and 29 for the extent of the wall so that they terminate before the side wall 13. In this way, the two electrodes 45 and 46 form two interdigitated combs, which do not make electrical contact with one another. Electrical connection is made with the respective electrodes 45 and 46 at terminals 58 and 59. The terminal 58 for the first electrode 45 is located at the free end of the outer arm 52; the terminal 59 for the second electrode 46 is located at the junction between its base 53 and an outer arm 57.

When a voltage is applied between the two glow mode electrodes 45 and 46, an electric field is produced primarily between adjacent arms of the two electrodes. This produces a substantially even electric field within the channels 15 to 22 between the dividing walls. This gives an even illumination when the lamp is used with a conventional diffuser. Such a diffuser will also help smooth variations in light output close to the tops of the walls.

The electrode tracks 45 and 46 do not substantially obscure the light produced by the lamp I because they are aligned with the tops of the dividing and outer walls, where there is lower light emission. To reduce any shadowing effect, the electrodes could be of a transparent material, such as a thin film of indium tin oxide. The electrodes could be made of various different materials such as of conductive inks, which may be applied by screen printing. The glow mode electrodes could be conductive tracks or wires on a transparent insulating film similar to a flexible PCB, which is adhered to the surface of the envelope. Flat panel lamps can be formed with many different external shapes and with discharge paths of various different shapes. It will be appreciated that the pattern of the glow mode electrodes can be changed to give the best performance with these different shapes. The electrodes need not be mounted on the front, viewing side of the lamp but could be on the back surface, although this has been found not to produce such an even illumination, because the plasma is closer to the phosphor on the front plate 44 of the lamp. In another arrangement, one electrode could be on the front and one on the back. Where an electrode is mounted on the back of the lamp, this could still be used with a heater, the tracks of a heating element being aligned with the midline of the discharge path and the or each electrode being aligned with the base of the dividing walls. Alternatively, the glow mode electrodes could be located internally of the envelope.

It has been found that the lamp system of the present invention can produce an even illumination over a wide range of brightness and can be smoothly faded or increased in brightness.

What is claimed is:

1. A gas discharge lamp comprising: a planar envelope filled with a discharge gas; a plurality of parallel walls extending part way across the width of said envelope defining a discharge path of serpentine shape within said envelope; a first pair of electrodes located at opposite ends of said discharge path for causing discharge within said envelope; and two glow mode electrodes, said glow mode electrodes being spaced from one another across the discharge path and extending in alignment above said walls so that a voltage can be applied between said glow mode electrodes across regions of said discharge path.

2. A gas discharge lamp according to claim 1, wherein both said glow mode electrodes extend along the same surface of said envelope.

3. A gas discharge lamp according to claim 2, wherein said glow mode electrodes are on a front side of said envelope through which light is emitted.

4. A gas discharge lamp according to claim 2, wherein said glow mode electrodes take the form of two interdigitated combs.

5. A gas discharge lamp according to claim 2, wherein said glow mode electrodes extend on an external surface of said envelope.

6. A gas discharge lamp according to claim 1, wherein said glow mode electrodes are of a transparent material.

7. A gas discharge lamp comprising: a planar envelope filled with a discharge gas; a plurality of parallel walls in said envelope forming a serpentine discharge path; a first pair of electrodes located at opposite ends of said discharge path for causing discharge within said envelope; and two glow mode electrodes, said glow mode electrodes being in the form of two interdigitated combs extending in alignment with the tops of the walls so that a voltage can be applied between said glow mode electrodes across regions of said discharge path.

* * * * *